United States Patent [19]

Bruno

[11] 4,002,006

[45] Jan. 11, 1977

[54] METHOD AND APPARATUS FOR PACKAGING GOODS

[76] Inventor: Edward C. Bruno, 4105 Holly St., Denver, Colo. 80216

[22] Filed: June 30, 1975

[21] Appl. No.: 591,420

[52] U.S. Cl. ..... 53/29; 53/183; 53/255; 53/390

[51] Int. Cl.[2] ..... B65B 9/14; B65B 67/02

[58] Field of Search ..... 53/29, 30 R, 37, 138 A, 53/183, 193, 255, 390; 248/99

[56] References Cited

UNITED STATES PATENTS

| | | | |
|---|---|---|---|
| 3,540,184 | 11/1970 | Ashton | 53/37 X |
| 3,726,060 | 4/1973 | McMillan | 53/138 A |

*Primary Examiner*—Robert Louis Spruill
*Attorney, Agent, or Firm*—Bruce G. Klaas

[57] ABSTRACT

A method and apparatus for forming individual containers from a length of an unexpanded continuous tube of expandable net-like material having an open end portion and a length several times longer than the length of the individual containers to be formed therefrom wherein a working length of the unexpanded continuous material is expandably opened by expansion means defining a container forming cavity; a container forming length portion of the continuous material, including the open end portion which is closed, is turned inside-out by placing goods to be packaged in the container forming cavity to cause the container forming portion to be located and expanded in the cavity with the closed end at the bottom of the cavity; and the end of the container forming portion containing the goods opposite the closed end is then severed from the continuous tube of material to form a separate individual package of goods.

27 Claims, 11 Drawing Figures

METHOD AND APPARATUS FOR PACKAGING GOODS

BACKGROUND AND SUMMARY OF INVENTION

This invention relates generally to apparatus and methods for packaging goods in expandable tubular packaging material sold in relatively long unexpanded lengths and, more particularly, to apparatus and methods for packaging goods in individual containers formed during packaging of the goods from a continuous relatively long length of the packaging material.

For many years, various edible goods, such as grapes, bananas, apples, oranges, grapefruit, lettuce, broccoli, cauliflower, potatoes, meats, etc., have been individually packaged for sale to the consumer at the retail level. Such packaging has taken place at various locations including at the point of shipment, at the wholesale point of distribution, and at the retail point of sale. A wide variety of packaging devices have been developed for this purpose including paper, fiber, and plastic bags and wrappers of a variety of designs. The commercial success of all such packaging devices is a function of both consumer and distributor acceptance involving the appearance of the goods in the package, the exposure of the goods to the touch and view of the consumer in the package, the effect of the package on the condition of the goods at the time of sale, and the cost of the packaging material, the cost of conversion of the packaging material into the packaging device, and the cost of packaging the goods in the packaging device.

For some time there have been available various kinds of produce packaging materials of the open mesh or net type which have certain advantages relating to the aforementioned factors of commercial success. However, such packaging materials have had certain disadvantages in terms of ease and cost of handling and packaging. The present invention provides a method and apparatus for improved ease of handling and packaging of goods with such materials at greatly reduced costs. In general, the present invention involves a method and apparatus for forming individual containers from a continuous length of such material while simultaneously packaging goods in the individual containers. The method and apparatus are such as not to require any packaging materials other than the continuous length of such material which can itself be utilized to form the container including complete closing of the container to prevent removal or loss of the goods by the simple expedient of tying off open ends of an expanded tubular section of the material. The apparatus required for packaging the goods is compact, simple to operate, composed of very few parts, and very inexpensive to manufacture. The apparatus comprises material container means for holding a continuous unexpanded length of the material in wound roll form or, preferably, in closely packed layers extending in zig-zag fashion and stacked in columnar relationship, a work table or surface, and a material expansion means for expanding a portion of the material into open tubular condition and for providing a cavity within the expanded portion of the goods for packaging the goods while forming an individual separate container of any desired size for any size or shape goods as hereinafter disclosed in detail by reference to the accompanying drawing.

BRIEF DESCRIPTION OF THE DRAWING

Presently preferred and illustrative embodiments of the inventive concepts are shown on the accompanying drawing wherein:

Referring now to FIGS. 1 and 2, in general, one form of the apparatus of the present invention is shown to comprise support means in the form of a separate work table 10 for supporting material expansion and container forming means 12 and providing a material supply chamber 14 for holding a relatively long length of a continuous unexpanded tube of resiliently stretchable mesh or net-like material 16 wound in roll form 17 in a cardboard box 18. The material may be obtained in varying lengths and widths of, for example, 1000 to 12,000 feet in length and 5 inches to 3 feet in width with an outer open end portion 20 located on the outer periphery of the supply of material. In addition, as illustrated in FIG. 11, in a presently preferred form of the invention, a continuous length of the material, in lengths of 2000 to 12,000 feet, may be closely packed in zig-zag layers 21 stacked one upon another in columnar fashion in the cardboard box 18.

Figure 2:
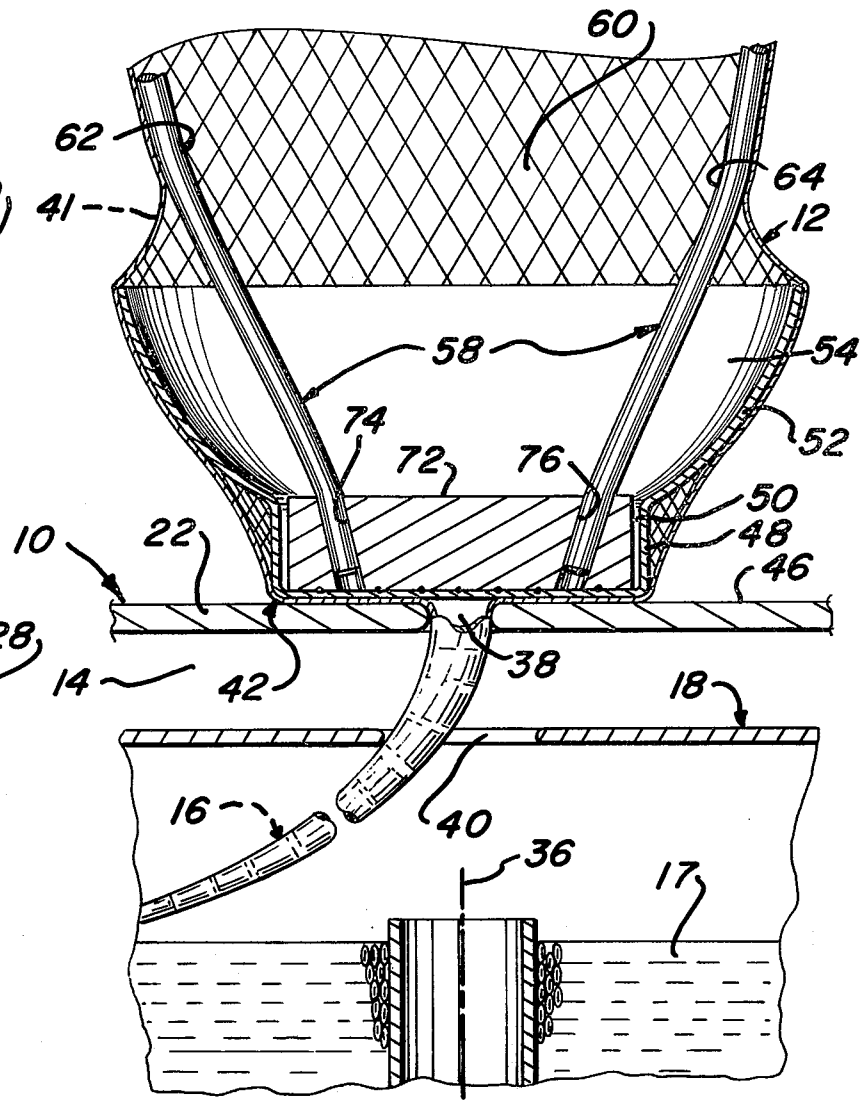
FIG. 2 is an enlarged side elevational view in cross-section of a portion of the apparatus of FIG. 1.
Figure 1:
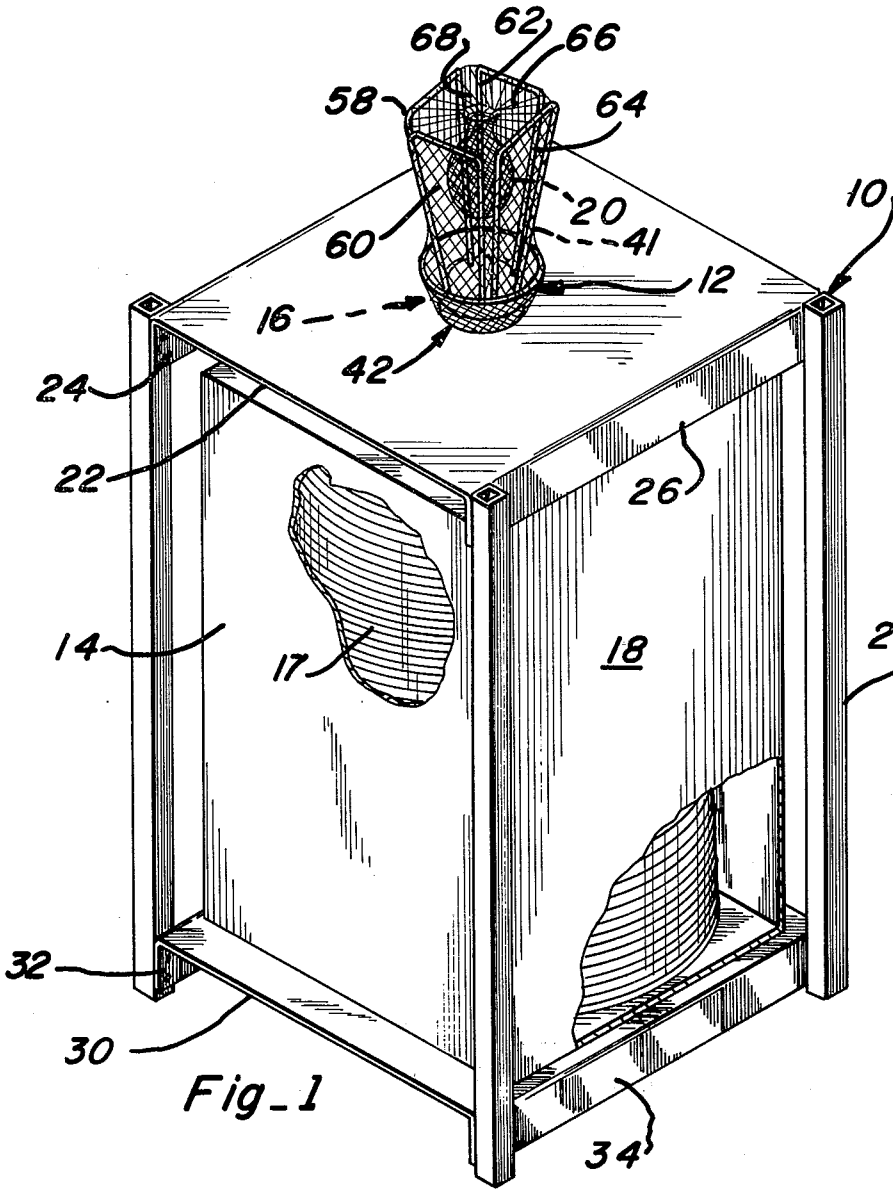
FIG. 1 is a perspective view of illustrative apparatus incorporating the inventive concepts and by which the method of the invention may be practiced.

While the present invention is particularly adapted for use with a resiliently stretchable expandable and contractable plastic net-like material known as Vexar and manufactured by I. E. DuPont Nemours Co. of Wilmington, Del., it is contemplated that the inventive concepts may be applicable to other types of materials.

In the illustrative form of the invention of FIGS. 1–10, the support means 10, which can be of any suitable construction, comprises an upper flat horizontally extending support plate member 22 having opposite spaced vertically extending side flanges 24, 26 and supported by four vertically extending leg members 28. A lower flat horizontally extending support plate member 30, having opposite spaced vertically extending side flanges 32, 34 is suitably attached to the bottom of leg members 28. The plate members 22, 30 and leg members 28 define the chamber 14 for receiving the cardboard box 18 containing the roll of material 16 and supporting the box 18 beneath the upper plate member 22 with the central axis 36 of the roll of material in a vertical position. Material supply passage means, in the form of a vertically extending passage 38 centrally located in the upper plate member 22 and a passage 40 centrally located in the top side wall of box 18, in general axial vertical alignment with the central axis 36 of the roll of material are provided to receive and guide the material from the box 18 to the container forming assembly 12. In the practice of the present invention, the outer open end portion 20 of the flattened material is pulled upwardly through opening 40 and passage 38 so as to provide a working length portion 41 of the material above plate member 22 which may be continuously replenished from the roll of material through opening 40 and passage 38. The opening 40 and passage 38 are preferably annular with smooth edge surfaces which may be beveled to facilitate passage of the material therethrough.

Figure 3:
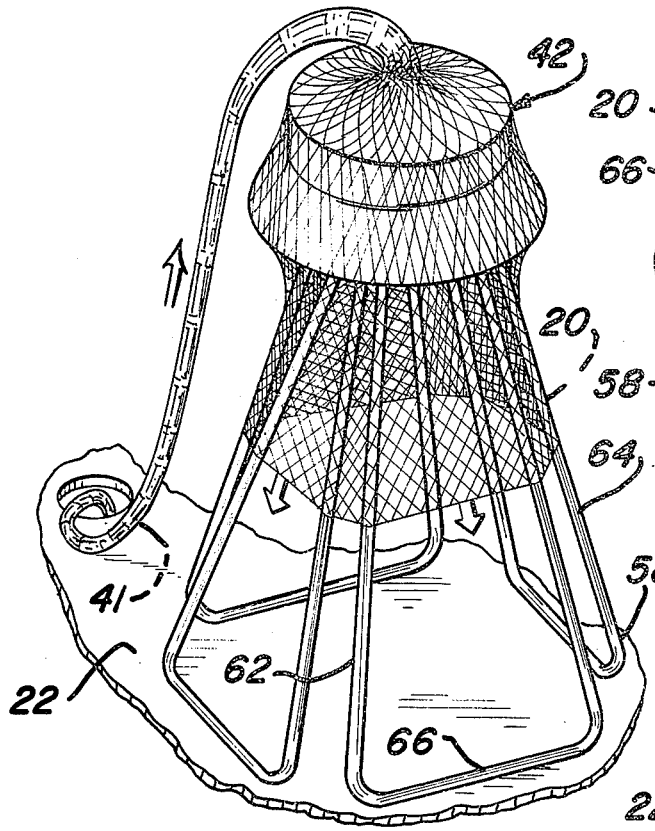
FIG. 3 is a perspective view of a container forming assembly of FIG. 1 in an inverted position showing a first step of the method of the present invention.
Figure 4:
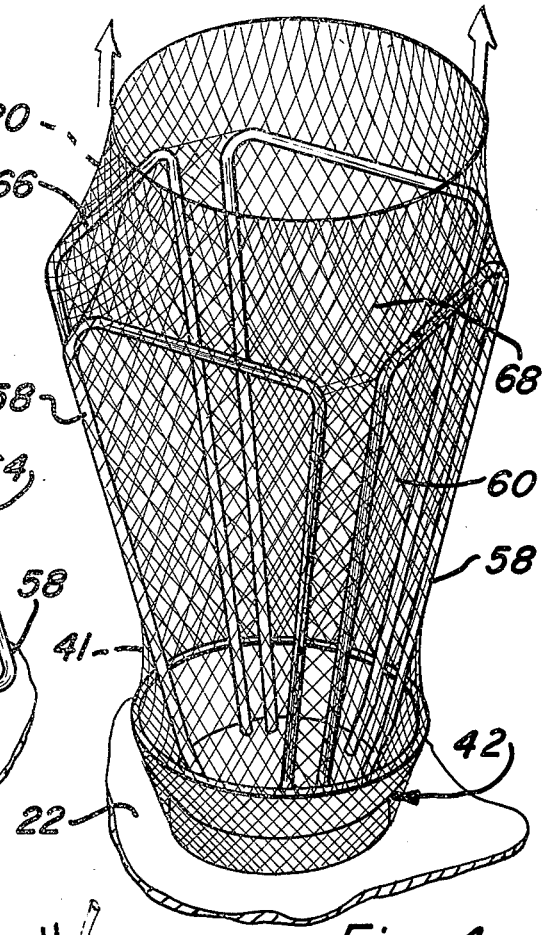
FIGS. 4–9 are perspective views of the container forming assembly of FIG. 1 showing intermediate steps of the method of the present invention.

The illustrative expansion and container forming means 12 of FIGS. 1–10, comprises base means, in the form of a dish-like member 42, for supporting the expansion and container forming means on the upper surface 46 of platform member 22 in circumjacent upwardly spaced relationship to passage 38. Member 42 has an annular bottom portion 48 defining an annular cavity 50 and an upwardly outwardly extending upper portion 52 defining a generally annular cavity 54 while providing outer generally annular inclined vertically extending guide surfaces about which the working length of material 41 is supported in an expanded open tubular position. The expansion and container forming means further comprises material spreading means in the form of a plurality of upwardly outwardly vertically extending elongated rod members 58 of similar construction which define elongated packaging chamber means in the form of a container forming cavity 60 therebetween. While it is contemplated that the number, shape and arrangement of the rod members may be varied as necessary or desirable, in the illustrative embodiment, there are four such members. Each rod member comprises a pair of spaced vertically extending elongated rod portons 62, 64 connected at the upper end by a transversely horizontally extending intermediate rod portion 66. The arrangement is such that each of the rod portions is equally upwardly outwardly inclined so as to be be generally located in the plane of an upwardly opening cone having a central axis coaxial with the dish-like member 44. In this manner, the cavity 60 has access opening means at the upper end in the form of an upwardly facing opening 68 of larger area and closure means at the lower end provided in the illustrative embodiment by the lower end portions of the rod members 58 and the bottom portion 48 of member 42 than the portions of the cavity therebeneath which are of downwardly decreasing area. The expansion and container forming means further comprises stabilization and rod mounting means in the form of an annular member 72 of heavy material, such as lead, for holding the container forming assembly in the vertical upright position and for securing the rod members to the base means. The outside diameter of member 72 is approximately equal to the inside diameter of annular bottom portion 48 so as to be closely slidably received therewithin in cavity 50. Each rod member is mounted on annular member 72 by a pair of circumferentially spaced generally axially extending inclined holes 74, 76 which receive and hold the ends of rod portions 62, 64. The arrangement is such as to provide adjustment means whereby the amount of inclination of the rod members, and thus the size of cavity 60, may be varied by bending the rod portions 62, 64 relative to the member 72. In practice of the present invention, the working portion 41 of the roll of material extends upwardly and outwardly from passage 38 in expanded tubular condition around the base means 42 and around the material spreading means 58 with a relatively short length of the material having the open end portion 20 extending beyond the upper portions 66 of the rod members and inwardly contracted as shown in FIG. 4.

Referring now to FIGS. 3–10, the method of the present invention is practiced in the following manner. In order to mount the working portion 41 of the material on the expansion and container forming means, the expansion and container forming means may be temporarily inverted, as shown in FIG. 3, with the open end 20 of the working portion 41 of the material extending upwardly through passage 38 then being manually expandably spread apart and telescopically placed over the base means 42 and pulled over the material spreading means 58, which frictionally retain the resiliently expanded material thereon, until the end portion 20 of the material extends beyond the rod members, as shown in FIG. 4, whereupon the end portion 20 will resiliently contract and at which time the expansion and container forming means is placed in the vertically upright working position above passage 38 on the upper surface 46 of plate member 22. The arrangement is such that, in the working position of FIGS. 4–10, the material extends between the base means 42 and the upper surface 46 of plate member 22 in slightly expanded condition as shown in FIG. 2, and the working length portion 41 of material may be increased and replenished by pulling the material through passage 38 between the bottom surface of the base means 42 and the upper surface 46 of the plate member 22. While the foregoing arrangement is satisfactory, it is contemplated that the base means 42 may be otherwise constructed and supported or mounted relative to the plate member 22 and passage 38 to eliminate any undesirable frictional contact of the material with the base means and/or the plate member.

Figure 5:
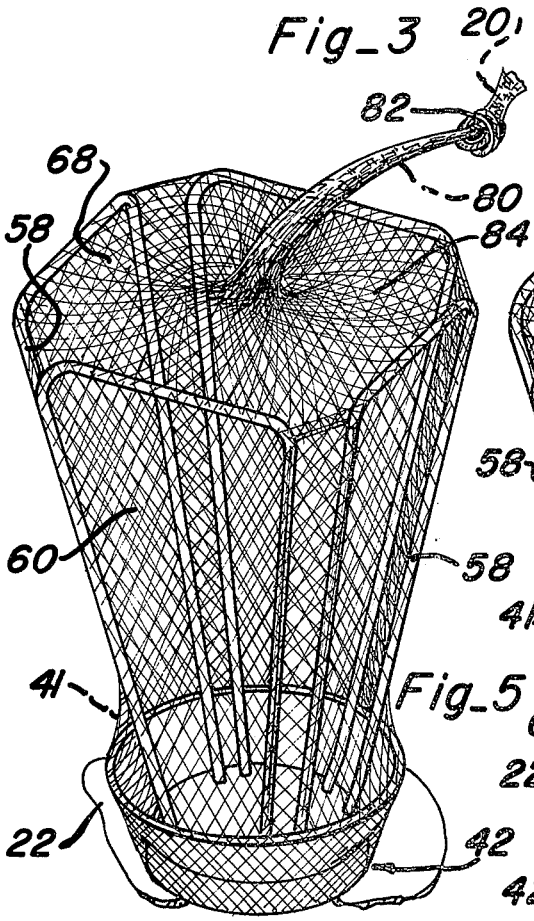
Figure 6:
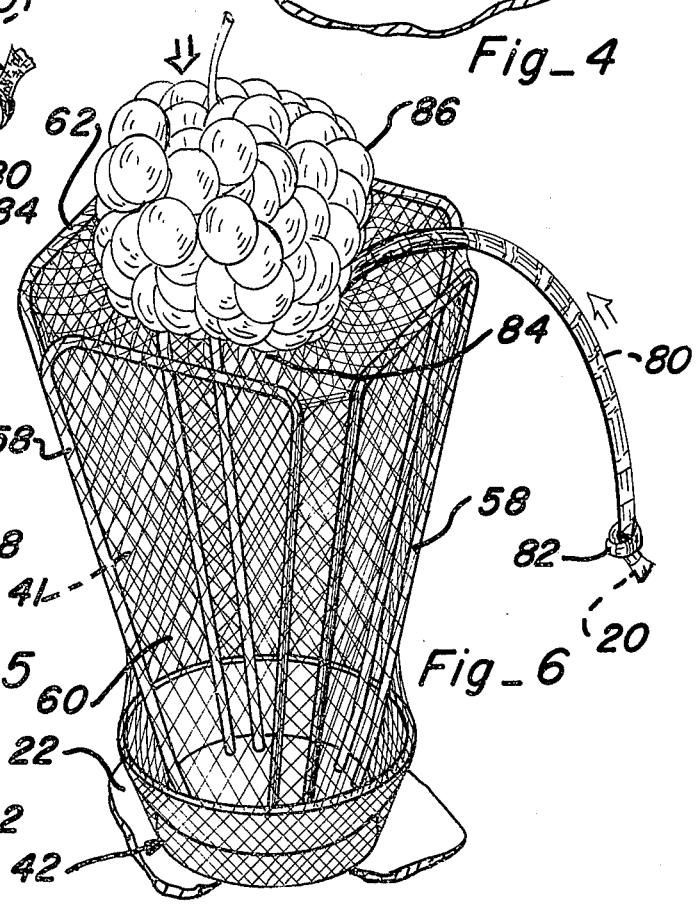

With the apparatus and the container material in the position shown in FIG. 4, the open end portion 20 of the material may be manually grasped and pulled upwardly to obtain a desired unexpanded length portion 80 of container forming material, as shown in FIGS. 5 and 6, and the unexpanded open end portion 20 of the material is closed in a suitable manner such as by tying a knot 82 in the material or by use of a tie device, staple or the like. While the length of the material portion 80 will vary depending on the size of the goods to be packaged, it is contemplated, for example, that relatively small items such as grapes or onions will require a length of approximately 13 inches whereas 5 pounds of apples or oranges will require a length of approximately 19 inches. The selected unexpanded length portion 86 of container forming material is then placed outside the cavity 60 and allowed to hang downwardly along the outer side of the material spreading means and the expanded working length portion 41 of the material supported thereon with the tied end 82 located in downwardly spaced relationship to the cavity opening 68 as shown in FIG. 6. At this time, expanded intermediate portions 84 of the material between the unexpanded length portion 80 of container forming material and the expanded working length portion 41 of material are stretched across the cavity 60 over the opening 68.

Figure 7:
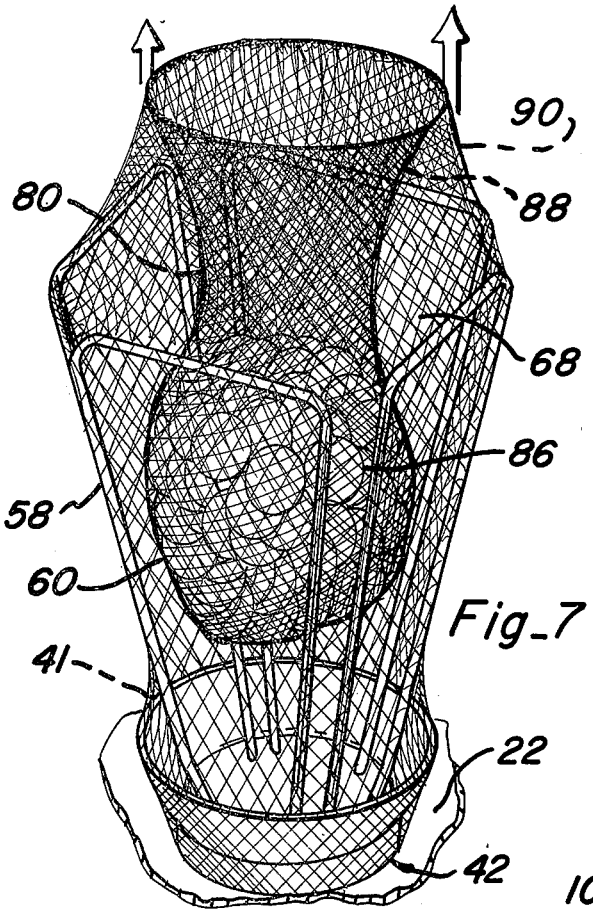

At this time, as shown in FIG. 6, the goods to be packaged, such as a bunch of grapes 86, are placed on the expanded intermediate portions 84 of the material above the cavity 60 at the opening 68 and moved downwardly into the cavity 60 by its own weight or by manually downwardly applied pressure as shown in FIG. 7. As a result, the tied end of the container form ing portion 80 of the material is pulled into the cavity 60 with the tied end located at the bottom of the cavity and with an expanded open upper end 88 being formed by the spreader means at the opening 68. It is noted that the original outer surface of the supply of material is then the inner surface of the container forming portion of the material and the original inner surface of the supply of material has become the outer surface of the container forming portion. It is further noted that the relatively wide spacing between the rod portions 62, 64, 66 and between adjacent rod members, as well as the resilient expandability of the material, enables irregularly shaped goods, such as a bunch of grapes, to be readily accommodated and supported within cavity 60.

Figure 8:
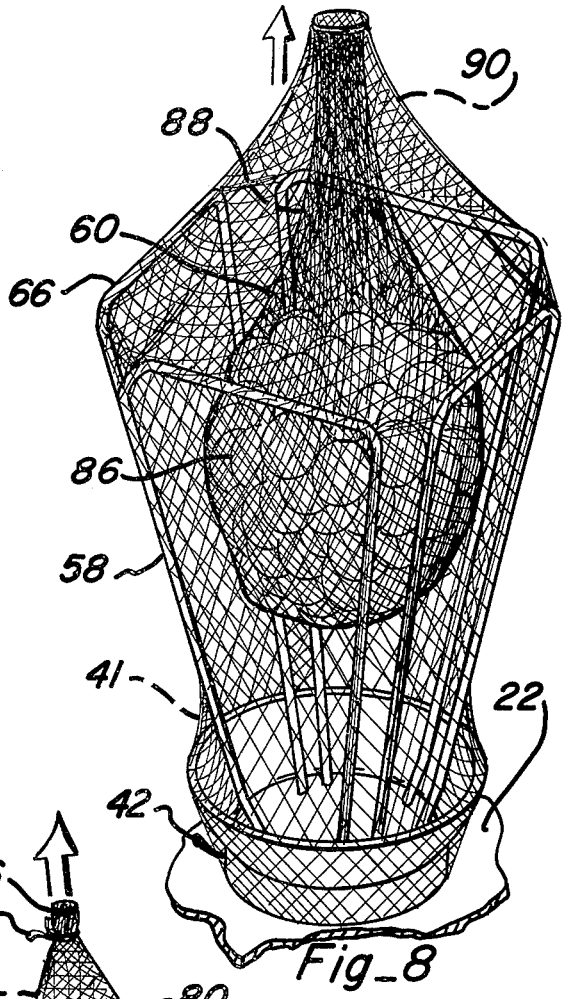
Figure 9:
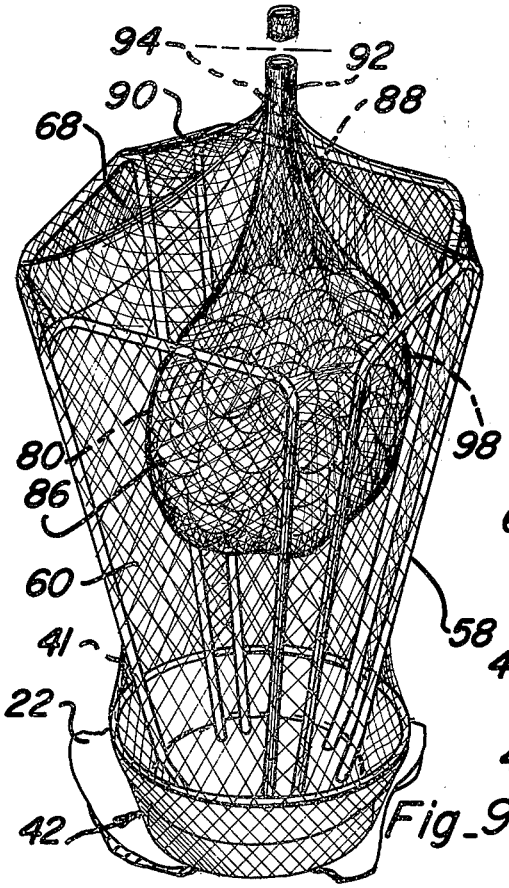
Figure 10:
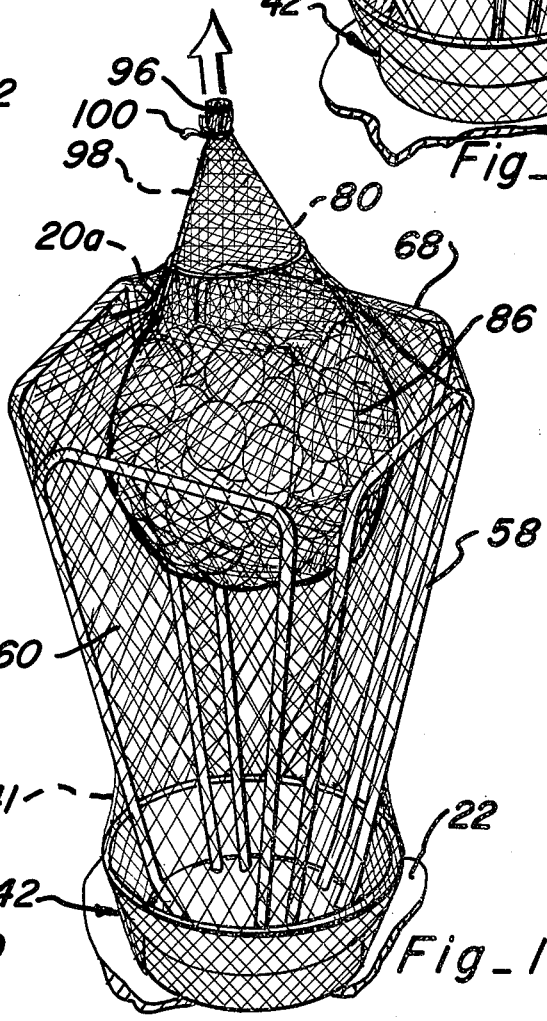
FIG. 10 is a perspective view of the container forming assembly of FIG. 1 showing a final step of the method of the present invention.

As shown in FIGS. 7–9, after the goods have been located in the container forming portion 80 of the material within the cavity 60 whereat the goods may be temporarily supported by the rod members 58, the expanded upper end 88 of the container forming portion as well as the expanded upper end 90 of the working portion 41 of the material are manually grasped and pulled upwardly to fully expand the container forming portion 80 into close conforming engagement with the goods while upwardly stretching and inwardly displacing the upper ends 89, 90 to cause the upper ends to assume generally conical configured slightly expanded end portions 88, 90, FIG. 8, upwardly terminating in relatively narrow-width unexpanded neck portions 92, 94, the resiliency of the material causing contraction of the material in the neck portions from the resiliently expanded condition of FIG. 7. Then, as shown in FIG. 9, the narrow-width neck portions 92, 94 ae severed by suitable severing means, such as a pair of scissors or other cutting tool, to provide an unexpanded open upper end 96 on the container forming portion 80, and thus defining a separate individual container 98, FIG. 10, for the goods having a closed end 82 and an expandable open end 96, while also providing a new open end portion 20*a* at the upper end of the working portion 41 of the continuous roll of material. The container 98 and the goods 86 in the container are then lifted out of the cavity 60, as shown in FIG. 10. If desired, the upper open end 96 of the container 98 may be closed by tying a knot or applying any suitable closing device 100 such as a wire, band, staple, etc. It will be apparent that the arrangement is such as to enable the operator to immediately begin the formation of a new individual separate container and packaging of goods therein by repeating the aforedescribed steps.

Figure 11:
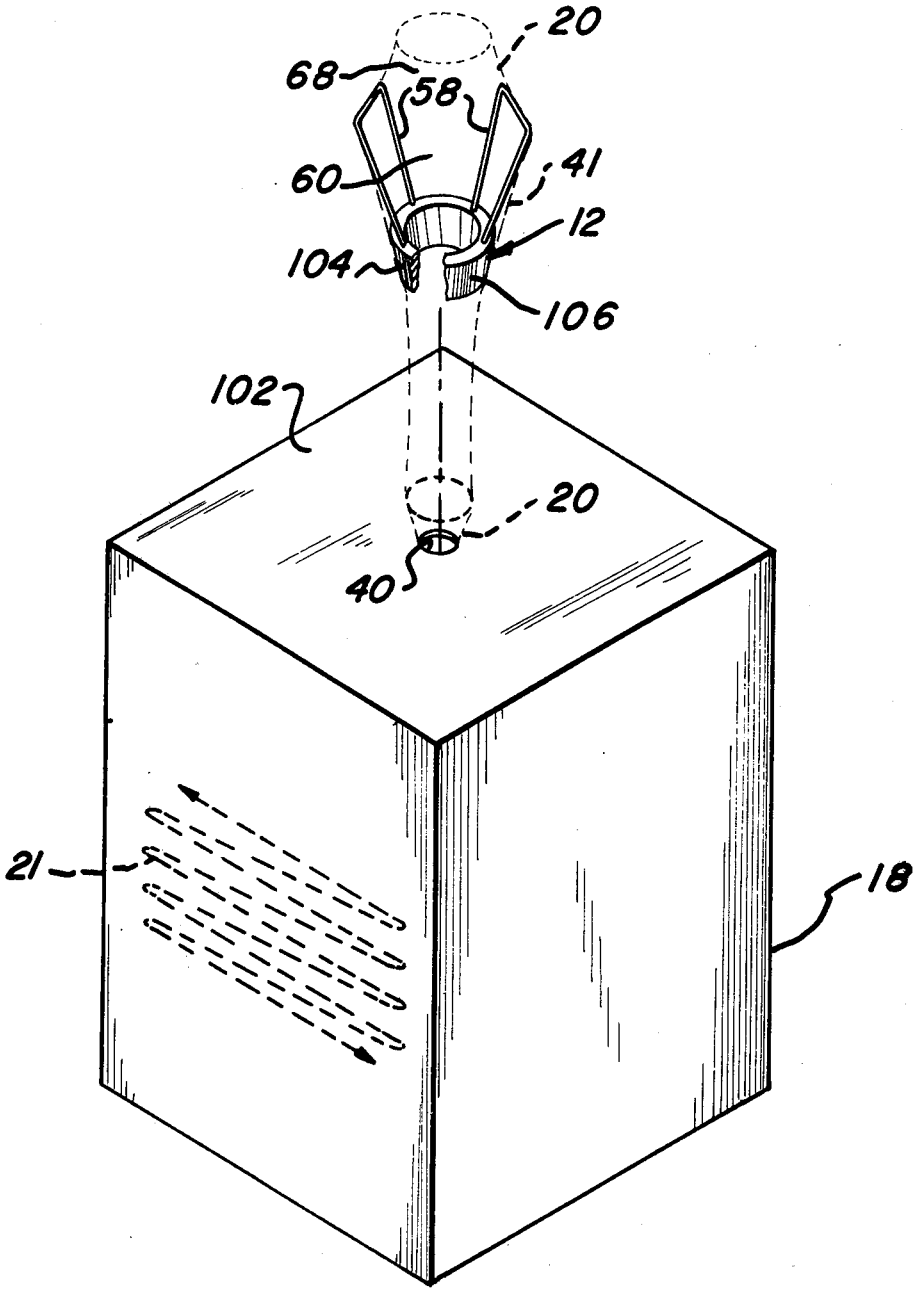
FIG. 11 is an exploded perspective view of a presently preferred embodiment of the inventive concepts.

Referring now to FIG. 11, a presently preferred form of the apparatus of the invention is shown to comprise material container means in the form of a cardboard box 18 containing a continuous length of the material packed therein in layers 21 extending across the box in a zig-zag pattern and closely compactly stacked from end to end and side to side of the box in columnar relationship therein as illustrated only generally in FIG. 11, it being understood that the layers 21 are much more closely packed in adjacent abutting relationship than illustrated. The open end portion 20 of the material extends through passage 40 in the top end of the box which itself may be used to provide an upwardly facing work surface 102 on which the expansion and container forming means 12 may be placed in axial alignment with passage 40. In the presently preferred form, the assembly 12 comprises a relatively heavy hollow cast base ring member 104 having a pair of opposite adjustable rod members extending upwardly and outwardly therefrom as previously described and providing an annular curved initial expansion surface 106. It is to be understood that the expansion and container means 12 may, alternatively, be placed on any available work surface adjacent to the box 18.

In use of the aforedescribed apparatus and method, substantial savings in cost of packaging of goods are attainable. For example, a supply of 12,000 feet of the continuous flattened unexpanded net-like tubular material can be utilized to make between 10,000 and 20,000 individual containers at costs estimated to be between one-half cent and one cent per individual container including the cost of the container forming apparatus. Since the net-like tubular material is available in varying widths, the apparatus and method may be employed to package virtually all kinds of goods including not only unpackaged or prepackaged edible items of produce, poultry, hams, nuts, citrus, etc. but also other prepacked edible items such as six packs of beverages and also any number of group of other unpackaged or prepackaged articles such as toys, cosmetics, soaps, commonly sold in chain-store and supermarket retail outlets.

While the aforedescribed apparatus and method have been implemented by manual operations, it is contemplated that apparatus and method may be automated in whole or in part. In addition, it is contemplated that the illustrative apparatus may be otherwise variously modified. Thus, it is intended that the appended claims be construed to include alternative embodiments of the inventive concepts except insofar as limited by the prior art.

The invention claimed is:

1. A method of packaging goods in separate individual containers formed from a length of a continuous unexpanded tube of expandable resilient net-like material having an open end and a length several times longer than the length of the individual containers to be formed therefrom, and comprising the steps of:

forming an open elongated cavity in only an intermediate portion of the continuous unexpanded tube of net-like material by resilient expansion of the intermediate portion, with the open end and portions of the continuous unexpanded tube of net-like material on opposite sides of the expanded intermediate portion being unexpanded, and providing an unexpanded end length portion between the expanded intermediate portion and the open end sufficient in length to form a container for the goods;

then closing the unexpanded open end of the continuous tube of net-like material to form a closed first end portion for the unexpanded end length portion;

then placing the unexpanded end length portion and the closed first end portion thereof within the open elongated cavity and expanding a portion of the end length portion next adjacent the intermediate portion to provide an access opening to place the goods into the end length portion;

then placing the goods within the end length portion through the access opening and thereby resiliently expanding the end length portion between the access opening and the closed first end portion to form a container conforming to the goods with the goods and the end length portion being located within the expanded intermediate portion of the tube of net-like material during the forming of the container; and then severing the end length portion from the intermediate portion of the tube of net-like material to provide a separate individual container for the goods having a second end portion opposite said closed first end portion.

2. The invention as defined in claim 1 and further comprising the steps of:

removing the separate individual container for the goods and the goods contained therein through the access opening.

3. The invention as defined in claim 1 and further comprising the steps of:

closing the second end portion of the end length portion to form a container for the goods closed at both ends of the container.

4. The invention as defined in claim 1 and further comprising the steps of:

removing the separate individual container for the goods and the goods contained therein through the access opening; and repeating the steps to form additional separate individual containers with the goods contained therein until the length of the continuous tube material has been completely utilized.

5. Apparatus for packaging of goods in separate individual containers formed from a length of an unexpanded continuous tube of resiliently expandable material having a terminal end portion and a length many times greater than the length of the separate individual containers to be formed therefrom, and comprising:

material expansion means for supporting and resiliently expanding an intermediate portion of the length of the net-like material adjacent the terminal end portion with the terminal end portion and portions of the continuous tube of net-like material on opposite sides of the expanded intermediate portion being unexpanded, and providing an unexpanded end length portion between the expanded intermediate portion and the terminal end portion sufficient in length to form a separate individual container for the goods;

elongated packaging chamber means defined by and located within said material expansion means for receiving the unexpanded end length portion of the net-like material, the terminal end portion being closed to prevent passage of goods therethrough; and access opening means at one end of said packaging chamber means for permitting placement therethrough of the unexpanded end length portion of the net-like material into said packaging chamber means, and for enabling placement therethrough of goods into the unexpanded end length portion of the net-like material within said packaging chamber means to form an individual container for the goods by resilient expansion of the unexpanded end length portion to accomodate the goods, and for enabling removal of the goods and the individual containers formed for the goods upon severance of the end length portion from the intermediate portion of the net-like material.

6. The invention as defined in claim 5 and further comprising:

container means for holding a large supply of the unexpanded continuous tube of net-like material; and passage means extending between said container means and said material expansion means for guiding the unexpanded continuous tube of net-like material from said container means to said material expansion means.

7. The invention as defined in claim 6 and further comprising:

support means for supporting said material expansion means comprising a platform member providing a work surface and a cavity for said container means therebelow.

8. The invention as defined in claim 7 and wherein:

said container means being mounted in said cavity and having an end wall located closely adjacent said platform member;

said passage means comprising a first passage in said platform member extending through said work surface and a second passage in said end wall of said container means aligned with said first passage; and said expansion means being supported on said work surface in alignment with said first passage.

9. The invention as defined in claim 7 and wherein:

said container means comprises an end wall portion supportable in an upwardly facing position;

said support means comprising an upwardly facing work surface provided on said end wall portion; and said passage means comprising a passage extending through said end wall portion transversely to said upwardly facing work surface.

10. The invention as defined in claim 6 and wherein:

said large supply of the continuous unexpanded tube of net-like material comprising folded lengths of material extending from side to side of said container means in zig-zag layers and said layers being closely packed in stacked columnar relationship in said container means with the terminal end portion next adjacent said passage means.

11. The invention as defined in claim 5 and wherein said material expansion means comprising:

base means for supporting said material expansion means on a work surface in a vertical upright position;

annular peripheral surface means on said base means for initiating expansion of the intermediate portion of the continuous tube of net-like material; and spreader means mounted on said base means and extending upwardly outwardly therefrom for further expansion of the intermediate portion of the continuous tube of net-like material.

12. The invention as defined in claim 11 and wherein said spreader means comprising oppositely transversely spaced rod members.

13. The invention as defined in claim 12 and wherein said rod members comprise:

circumferentially spaced vertical leg portions connected at one end to said base means and extending upwardly from said base means; and transversely horizontally extending connecting portions connected to and extending between said leg portions.

14. The invention as defined in claim 11 and wherein said base means comprising weight means for holding said material expansion means in the vertical upright position.

15. The invention as defined in claim 11 and wherein said spreader means comprising adjustment means for varying the size of said access opening means and said elongated packaging chamber means.

16. Apparatus for packaging of goods in separate individual containers formed from a length of an unexpanded continuous tube of resiliently expandable net-like material having a terminal end portion and a length many times greater than the length of the separate individual containers to be formed therefrom, and comprising:

material expansion means for supporting and resiliently expanding only an intermediate portion of the length of net-like material adjacent the terminal end portion, with the terminal end portion and portions of the continuous tube of net-like material on opposite sides of the expanded intermediate portion being unexpanded, and providing an unexpanded end length portion between the expanded intermediate portion and the terminal end portion sufficient in length to form a separate individual container for the goods;

elongated packaging chamber means defined by and located within said material expansion means for receiving the unexpanded end length portion of the net-like material, the terminal end portion of the net-like material being closed to prevent passage of goods therethrough;

holding means for holding and supporting goods placed within the unexpanded end length portion of the net-like material within said packaging chamber means; and access opening means at the upper end of said packaging chamber means for permitting placement therethrough of the unexpanded end length portion of the net-like material into said packaging chamber means, and for enabling placement therethrough of goods into the unexpanded end length portion of the net-like material within said packaging chamber means to form an individual container for the goods by resilient expansion of the unexpanded end length portion to accomodate the goods and for enabling removal therethrough of the goods and the individual container formed in said packaging chamber means by vertical upward movement.

17. The invention as defined in claim 16 and further comprising:

container means for holding a large supply of the unexpanded continuous tube of net-like material; and passage means extending between said container means and said base means for guiding the continuous unexpanded tube of net-like material from said container means to said expansion means.

18. The invention as defined in claim 16 and further comprising:

closure means at the lower end of said packaging chamber means opposite said access opening means preventing further downward passage of the goods placed within the unexpanded end length portion of the net-like material.

19. Apparatus for packaging of goods in individual containers formed from an unexpanded continuous tube of resiliently expandable net-like material having a terminal end portion and a length several times greater than the length of the individual containers, and comprising:

material expansion means for supporting and resiliently expanding an intermediate portion of the continuous tube of net-like material adjacent the terminal end portion;

elongated packaging chamber means for receiving an unexpanded length of the continuous tube of net-like material beyond the intermediate portion next adjacent the terminal end portion and sufficient in length to form an individual container;

access opening means at one end of said elongated packaging chamber means for insertion into said elongated packaging chamber means of an unexpanded length of the continuous tube of net-like material extending beyond the intermediate portion next adjacent the terminal end portion and sufficient in length to form an individual container with the terminal end portion located at the end of said elongated chamber means opposite said one end, and for forming an opening, in the end of the length of the continuous tube of net-like material sufficient in length to form an individual container, opposite the terminal end portion to enable the goods to be packaged to be inserted into the unexpanded length of the continuous tube of net-like material sufficient to form an individual container through said access opening means and thereby to cause expansion thereof to accomodate the goods;

support means for supporting said material expansion means in a work position;

container means for holding a large supply of the continuous unexpanded tube of net-like material; and passage means extending between said container means and said support means for guiding the continuous unexpanded tube of net-like material from said container means to said expansion means.

20. The invention as defined in claim 19 and wherein:

said support means comprises a platform member providing a work surface and a cavity for said container means therebelow;

said container means being mounted in said cavity and having an end wall located closely adjacent said platform member;

said passage means comprising a first passage in said platform member extending through said work surface and a second passage in said end wall of said container means aligned with said first passage; and said expansion means being supported on said work surface in alignment with said first passage.

21. The invention as defined in claim 19 and wherein:

said container means comprises an end wall portion supportable in an upwardly facing position;

said support means comprising an upwardly facing work surface provided on said end wall portion; and said passage means comprising a passage extending through said end wall portion transversely to said upwardly facing work surface.

22. The invention as defined in claim 19 and wherein:

said large supply of the continuous unexpanded tube of net-like material comprising folded lengths of material extending from side to side of said container means in zig-zag layers and said layers being closely packed in stacked columnar relationship in said container means with the terminal end portion next adjacent said passage means.

23. Apparatus for packaging of goods in individual containers formed from an unexpanded continuous tube of resiliently expandable net-like material having a terminal end portion and a length several times greater than the length of the individual containers and comprising:

material expansion means for supporting and resiliently expanding an intermediate portion of the continuous tube of net-like material adjacent the terminal end portion;

elongated packaging chamber means for receiving an unexpanded length of the continuous tube of net-like material beyond the intermediate portion next adjacent the terminal end portion and sufficient in length to form an individual container;

access opening means at one end of said elongated packaging chamber means for insertion into said elongated packaging chamber means of an unexpanded length of the continuous tube of net-like material extending beyond the intermediate portion next adjacent the terminal end portion and sufficient in length to form an individual container with the terminal end portion located at the end of said elongated chamber means opposite said one end, and for forming an opening, in the end of the length of the continuous tube of net-like material sufficient in length to form an individual container, opposite the terminal end portion to enable the goods to be packaged to be inserted into the unexpanded length of the continuous tube of net-like material sufficient to form an individual container through said access opening means and thereby to cause expansion thereof to accomodate the goods; and said material expansion means comprising:

base means for supporting said material expansion means on a work surface in a vertical upright position;

annular peripheral surface means on said base means for initiating expansion of the intermediate portion of the continuous tube of net-like material; and spreader means mounted on said base means and extending upwardly outwardly therefrom for further expansion of the intermediate portion of the continuous tube of net-like material.

24. The invention as defined in claim 23 and wherein said spreader means comprising oppositely transversely spaced rod members.

25. The invention as defined in claim 24 and wherein said rod members comprise:

circumferentially spaced vertical leg portions connected at one end to said base means and extending upwardly from said base means; and transversely horizontally extending connecting portions connected to and extending between said leg portions.

26. The invention as defined in claim 23 and wherein said base means comprising weight means for holding said material expansion means in the vertical upright position.

27. The invention as defined in claim 23 and wherein said spreader means comprising adjustment means for varying the size of said access opening means and said elongated packaging chamber means.

* * * * *